United States Patent [19]

Anguish

[11] 4,102,090

[45] Jul. 25, 1978

[54] ROOF FLANGE FOR HORIZONTAL PIPES

[75] Inventor: Jerry Lee Anguish, Mineral Wells, Tex.

[73] Assignee: Butler Ventamatic Corp., Mineral Wells, Tex.

[21] Appl. No.: 837,174

[22] Filed: Sep. 28, 1977

[51] Int. Cl.[2] ..... E04D 13/14

[52] U.S. Cl. ..... 52/58; 52/199; 52/219; 285/42

[58] Field of Search ..... 52/58, 199, 219, 173, 52/220, 200; 285/42–44; 126/271

[56] References Cited

U.S. PATENT DOCUMENTS

| | | | |
|---|---|---|---|
| 1,875,640 | 9/1932 | Moore | 285/44 |
| 2,985,465 | 5/1961 | Church | 285/43 X |
| 3,895,467 | 7/1975 | Clement | 52/199 |
| 3,945,163 | 3/1976 | Nagler | 52/219 |
| 4,010,578 | 3/1977 | Logsdon | 52/58 |

FOREIGN PATENT DOCUMENTS

| | | | |
|---|---|---|---|
| 257,425 | 11/1965 | Australia | 126/271 |
| 2,317,726 | 1/1974 | Fed. Rep. of Germany | 52/200 |

*Primary Examiner*—Alfred C. Perham
*Attorney, Agent, or Firm*—Fleit & Jacobson

[57] ABSTRACT

A unitary roof flange provides a weather-tight seal for horizontally arranged pipes entering a pitched, shingled roof. The flange is formed in one piece of plastic material and has substantially flat upper surfaces, so as to present surfaces which are substantially parallel to the roof surface to facilitate the flow of water thereover. The pipe enters the inventive flange at a surface which is downwardly facing in relation to the slope of the roof. A rubber grommet is provided at the interface between the horizontal pipe section and the roof flange to form a weather-tight seal.

9 Claims, 3 Drawing Figures

ROOF FLANGE FOR HORIZONTAL PIPES

BACKGROUND OF THE INVENTION

The present invention relates to flanges for use with pitched roofs to permit pipes arranged substantially horizontally to the ground to enter the roof while preventing any moisture from leaking or seeping through the roof or around the pipe.

There are presently known, numerous examples of flanges and flashings which are intended to provide a weather-tight seal for vertical pipes entering a sloping roof. Such flanges are typically formed of metal and have a frustoconical upstanding portion which encircles the vertical pipe. Sealing compound such as roofing cement, tar, or the like, is then typically poured around the area where the pipe meets the frustoconical neck of the flashing and also where the flashing meets the roof. More recently, resilient O-rings have been mounted inside the upstanding portion of the flashing as to form a seal without the need for sealing compound. Additionally, roof flanges are well-known for use with vent pipes that terminate only a short distance above the roof surface. These roof flanges are provided with tab portions at the opening and, once the pipe has been arranged to protrude through the roof, the flange is then placed over the protruding pipe and the tabs of the flange turned down over the exposed open end of the vent pipe. The lower part of the flange is then sealed to the roof, thereby preventing any moisture or the like from entering the area where the vent pipe exits the roof.

However, none of these known flanges or flashings have proven to be useful when used in a situation involving pipes arranged substantially horizontally to the ground and which enter a sloped or pitched shingled roof. Due to the recent increase in the use of solar energy collectors, which are intended to be mounted on the roofs of dwellings, a need has arisen for some suitable flashing means to permit a horizontal pipe to enter a pitched, shingled roof. Since most solar energy collectors utilize a liquid, either water or some other fluid, as the heat transfer medium and are generally located upon the dwelling roof, at least two of these pipes are required to enter the sloped roof of the dwelling. The flanges and flashings currently available have not proven satisfactory in the horizontal pipe situation, since almost all of the current designs of roof flashings utilize the frustoconical upstanding portions which do not blend in with the roof line of the building and which provide such an extreme angle that the pipe cannot enter the roof in its intended horizontal orientation.

BRIEF SUMMARY OF THE INVENTION

The present invention provides a specially formed unitary flange or flashing which is intended for use with pipes which are arranged to enter a pitched, shingled roof in a substantially horizontal orientation. The flange is provided with a flat front portion which faces downwardly, in the direction of the roof slope and it is at this point where the pipe enters the flange. A specialized rubber grommet is utilized at this location, where the pipe enters into the flange, to prevent any moisture from seeping there around. The flange is formed having only flat upper surfaces, thereby providing a generally flat overall construction. In this way the edges of the flanges are constructed so as to fit under the existing shingles. This construction also permits the flanges, installed at the points where the pipes enter the sloping roof, to blend in with the overall slope of the roof, so as to be both esthetically pleasing and also to provide the least possible impedence to rain water and the like as it flows down the roof.

The flange is preferred to be made of plastic and to be formed in only one piece, i.e., the flange is of a unitary construction so as to prevent any possible leakage from occuring at seams or joints. The flange may be vacuum formed of various plastics such as polyvinyl chloride (PVC), acrylonitride-butadiene-styrene copolymer (ABS), polypropylene, or the like. The grommet may be formed of any suitable elastometric material; however, rubber has proven to be very satisfactory. By forming the flange of plastic, not only does the flange become much more weather resistant but also, since metal is not used, there is no possibility of any electrolytic action between the pipe, which may be cast iron, and the flange, which might be zinc coated steel, tin, or copper. Therefore a potential source of corrosion is eliminated.

Additionally, the present invention is shaped so as to present such a low profile that it may be used on various sloped roofs which do not have the same pitch. Also, by means of the specialized design of the present flange, the basic roof flange may be easily adapted to accommodate various sizes of outside diameters of horizontal pipe. The different pipe sizes, of course requiring attendantly sized grommets.

Accordingly, it is an object of the present invention to provide a unitary roof flange to permit pipes arranged substantially horizontally to the ground to enter a pitched, shingled roof and to prevent any leakage at the point of entry of the pipe into the roof.

It is another object of the present invention to provide a unitary roof flange formed of plastic material and utilizing a resilient rubber grommet to form a seal between the roof flange and the entering pipe.

It is a still further object of the present invention to provide a unitary roof flange having an extremely low profile so as to blend in with the slope of the roof, yet to provide a substantially weather-tight seal for horizontal pipes entering a pitched, shingled roof.

It is another object of the present invention to provide a unitary plastic roof flange having wide, platelike edges which are intended to be arranged underneath the existing shingles of the pitched roof.

The manner is which these and other objects are achieved by the present invention will become apparent from the following detailed description.

DETAILED DESCRIPTION OF THE PREFERRED EMBODIMENT

Figure 1:
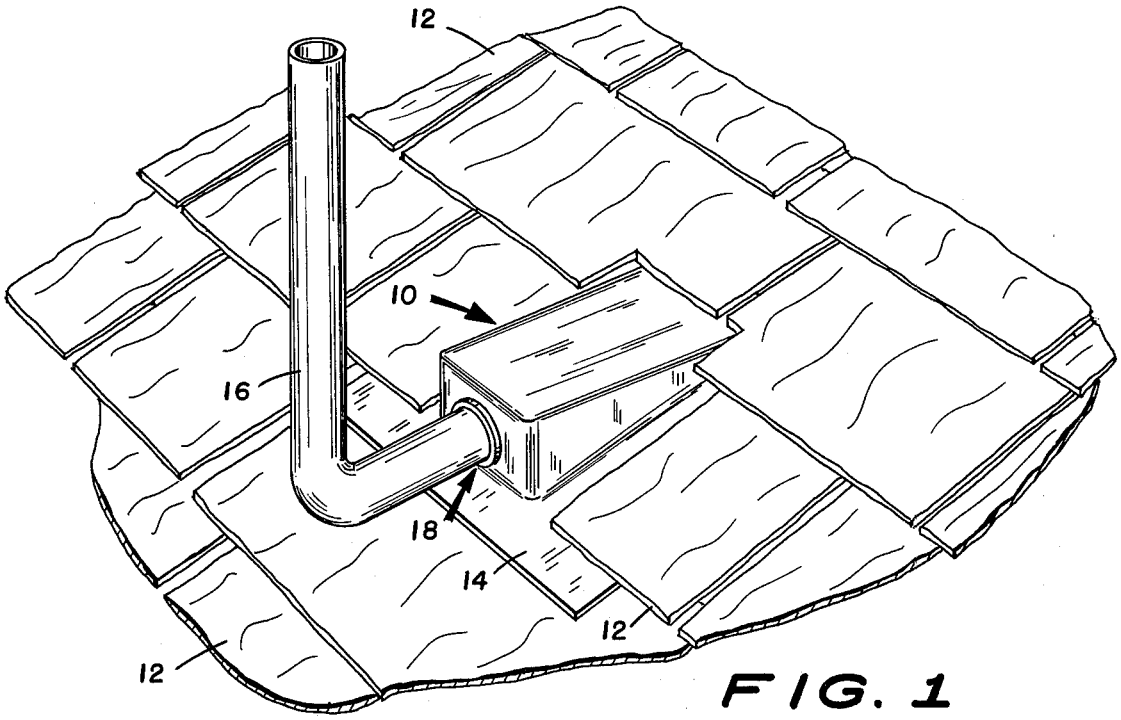
FIG. 1 is a perspective of a pitched, shingled roof having the invention flange installed thereupon.

FIG. 1 shows the inventive roof flange 10 having been installed on a pitched, shingled roof, and in this case the shingles, shown typically at 12 are of the wooden variety commonly referred to as shake shingles. As will become apparent from the following discussion, the present invention is suitable for use with conventional asphalt shingles and also with any of the other types of shingles currently in use today. The wide edges, shown generally at 14, of the flange 10, may be located underneath the existing shingles 12, therefore preventing any possibility of leakage at the interface where the flange is mounted on the roof. A pipe 16 may be a part of the roof-mounted solar collector (not shown) and, at the point of entry into the roof, is generally arranged substantially horizontally with respect to the ground. A rubber grommet 18 is positioned where the horizontal pipe 16 enters the flange 10.

Figure 2:
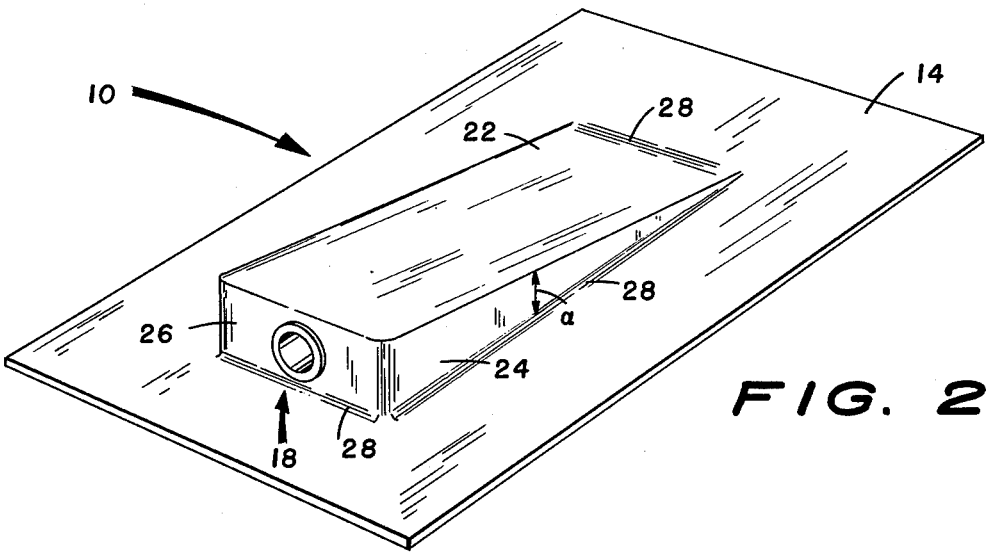
FIG. 2 is a perspective of the inventive roof flange.

FIG. 2 shows the flange 10 in a free state, not installed on a roof. The grommet 18 has been installed and the flange has been formed substantially flat with the wide, plate-like, area 12 providing a surface for sliding under the existing roof shingles. The flange 10 is formed having a flat top surface 22. The top surface 22 is formed as a flat surface so that any precipitation falling upon the roof will continue to flow down the roof and will not be caused to collect around either the interface of the pipe and the flange or the interface of the flange and the roof.

The angle $\alpha$, formed by the flat top surface 22 and the wide edges 12 is chosen to be approximately 15°, which presents a relatively minor change in roof slope and, therefore, does not seriously or adversely affect the flow of precipitation down the roof and does not present any corners or joints or the like where water may enter into the roof. This also permits the roof flange to be relatively unobtrusive after installation.

The inventive roof flange is intended to be vacuum formed or molded in a single piece and, as may be seen from FIG. 2, the top surface 22 and all upwardly raised portions 24, 26 are joined with the wide edge 12 by a smooth joint shown typically at 28. It has been found that vacuum forming the flange from an ABS plastic, called Cycolac, provides an exceptional end product.

The front raised portion 26 of the inventive flange 10 is of a sufficient size to permit a suitable sized hole to be drilled therethrough so that the grommet 16 may be inserted. By changing the size of the bore in the front raised surface 26 various size pipes may be accommodated with the only attendant change being the requirement for different sized grommets. Additionally, the flange 10 has been designed so that the upwardly raised portion 26 is facing downwardly in relation to the slope of the roof. In this way water running down the roof will not be washing against the joint formed where the pipe enters the flange 10.

Figure 3:
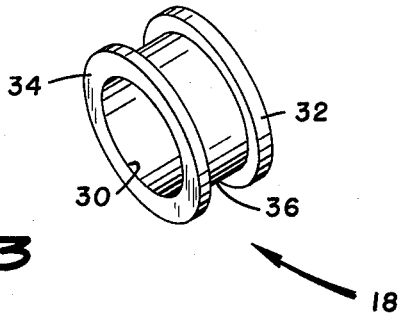
FIG. 3 is a perspective of a rubber grommet suitable for use in the inventive roof flange of FIG. 2.

FIG. 3 shows the grommet 18, of FIGS. 1 and 2, in more detail. The grommet 18 is intended to be formed of rubber or any suitable elastomeric material so that it may form a weather-tight seal between the pipe 16 and the inventive flange 10. The inner diameter 30 of the grommet is chosen to be only slightly smaller than the other diameter of the pipe which is intended to be conducted into the house. Two raised portions 32, 34 of substantially larger diameter are provided which act as stop rings and which, upon installation of the grommet in the hole provided in the upraised surface 26 of FIG. 2, prevent the grommet from being displaced or dislocated. The portion which seals the grommet 18 to the bore in the upraised portion 26 of FIG. 2 is shown at 36 and is provided with a diameter which is slightly larger than the hole formed in the upraised portion 26. In this way the rubber grommet 18 may be tightly affixed in the bore upon insertion of the pipe 16 into the grommet 18, since the grommet 18 will expand and seal in a water-tight manner with the flange 10.

During installation of the inventive flange 10, the shingles are cut away appropriately and the flange may be then slid up and under the remaining portions of the shingles. If necessary, a small amount of adhesive may be uses to seal the flange to the roof, although in general this is not necessary. It is not contemplated that the inventive flange should be nailed to the roof, since this merely provides additional possibilities for water leakage.

It is understood, of course, that the above description of the preferred embodiment is given by way of example only and that various other configurations as well as use of other materials are also contemplated by the present invention. For example, the grommet may be formed in various ways and of various materials such as silicone rubber or the like and the flat plate area 12 may be as large or as small as is necessary for the particular installation.

I claim:

1. A roof flange assembly for providing a weather-tight seal around a pipe entering a sloped roof, said roof flange assembly comprising:

a unitary plastic plate having substantially wide flat edge portions and having a centrally located hollow upraised portion, said upraised portion having a substantially flat top surface and defining a substantially vertically arranged forward facing flat portion and two upraised flat side portions, an aperture located in said forward facing flat portion and communicating with the interior of said upraised portion, and a resilient grommet arranged in said aperture so as to form a seal with said forward facing flat portion therebetween and having an inside diameter selected to fit tightly around said pipe.

2. The roof flange assembly of claim 1, wherein said plastic material is acrylonitride-butadiene-styrene copolymer and is vacuum formed thereof.

3. The roof flange assembly of claim 1 wherein said flat top surface and said flat edge portion form an angle of approximately 15°.

4. The roof flange assembly of claim 1 wherein said grommet is formed of rubber.

5. The roof flange assembly of claim 1 wherein said roof flange is arranged for installation on a pitched, shingled roof and said wide flat edges have a width such that when said flange is slipped under the shingles said shingls will substantially overlap said edges.

6. A roof flange assembly for providing a weather-tight seal for a pipe substantially horizontally to the ground entering a pitched, shingled roof, said roof flange assembly comprising:

a sheet of plastic material having formed therein an upraised hollow portion having a sloping, flat top surface and three flat side portions, a flat edge portion completely surrounding said upraised portion, said flat top surface joining said edge portion and forming an acute angle with said edge portion, an aperture located in one of said flat side portions opposite the jointure of said top surface and said edge portion, and a resilient grommet tightly arranged within said aperture and having an inside diameter smaller than the outside diameter of said pipe.

7. The roof flange assembly of claim 6 wherein said aperture is located facing in the direction of the slope of pitched, shingled roof.

8. The roof flange assembly of claim 6 wherein said acute angle is fifteen degrees.

9. The roof flange assembly of claim 8 wherein said edge portion is of a width such that upon being installed on said roof, said shingles will substantially overlap said edge portion.

* * * * *